US010118784B2

(12) United States Patent
Gabler et al.

(10) Patent No.: US 10,118,784 B2
(45) Date of Patent: Nov. 6, 2018

(54) PACKAGING MACHINE WITH A PROTECTIVE DEVICE AND METHOD

(71) Applicant: MULTIVAC SEPP HAGGENMÜLLER GMBH & CO. KG, Wolfertschwenden (DE)

(72) Inventors: Albert Gabler, Wolfertschwenden (DE); Wolfgang Negele, Ottobeuren (DE); Stefan Bieringer, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 1001 days.

(21) Appl. No.: 14/137,467

(22) Filed: Dec. 20, 2013

(65) Prior Publication Data

US 2014/0182246 A1 Jul. 3, 2014

(30) Foreign Application Priority Data

Dec. 28, 2012 (EP) ..... 12008645

(51) Int. Cl.

| | |
|---|---|
| ***B65B 9/04*** | (2006.01) |
| ***B65B 11/52*** | (2006.01) |
| ***B65B 31/02*** | (2006.01) |
| ***B65H 20/02*** | (2006.01) |
| ***B65B 57/00*** | (2006.01) |
| ***B65B 7/16*** | (2006.01) |
| *B65B 47/00* | (2006.01) |

(52) U.S. Cl.

CPC ..... *B65H 20/02* (2013.01); *B65B 7/162* (2013.01); *B65B 57/005* (2013.01); *B65B 47/00* (2013.01)

(58) Field of Classification Search

CPC ..... B65B 7/164; B65B 9/04; B65B 11/52; B65B 31/02; B65B 31/028; B65B 47/00; B65B 7/16; B65B 59/04; B65H 20/02; B29C 66/876; B29C 66/8762

USPC ... 53/559, 561, 511, 329.3, 329.4, 393, 396, 53/285; 220/811, 812, 349; 312/323, 312/327, 328; 49/254, 257, 258, 259, 49/260, 261

See application file for complete search history.

(56) References Cited

U.S. PATENT DOCUMENTS 2,338,477 A * 1/1944 Wolters ..... A47B 63/00 217/60 R
2,655,067 A * 10/1953 Bechler ..... B23Q 11/08 451/451
3,525,177 A * 8/1970 Robinson ..... E05D 7/1072 312/323

(Continued)

FOREIGN PATENT DOCUMENTS

DE 8623122 U1 1/1987
DE 19920260 A1 11/2000

(Continued)

*Primary Examiner* — Hemant M Desai
*Assistant Examiner* — Mary Hibbert
(74) *Attorney, Agent, or Firm* — Husch Blackwell LLP

(57) ABSTRACT

The present invention refers to a packaging machine and a method, wherein one embodiment of a protective device comprises a protective hood and the protective hood is lifted around a shaft comprising two rolls, and is shifted by means of guides in the protective hood on the rolls.

18 Claims, 4 Drawing Sheets

(56) References Cited

U.S. PATENT DOCUMENTS

| | | | | |
|---|---|---|---|---|
| 3,693,318 | A * | 9/1972 | Balzer | B65B 7/164 53/329.3 |
| 2001/0017021 | A1* | 8/2001 | Sanfilippo | B65B 31/028 53/432 |
| 2009/0288365 | A1* | 11/2009 | Negele | B65B 31/028 53/329 |
| 2012/0291400 | A1* | 11/2012 | Ehrmann | B65B 9/04 53/396 |

FOREIGN PATENT DOCUMENTS

| | | | |
|---|---|---|---|
| DE | 102008053665 | A1 | 5/2010 |
| EP | 0483446 | A1 | 5/1992 |
| EP | 1772384 | A1 | 4/2007 |
| EP | 1996470 | A1 | 12/2008 |
| WO | 2011154743 | A1 | 12/2011 |

* cited by examiner

PACKAGING MACHINE WITH A PROTECTIVE DEVICE AND METHOD

CROSS-REFERENCE TO RELATED APPLICATIONS

This Application claims priority to European Application Number 12008645.9 filed Dec. 28, 2012, to Albert Gabler, Wolfgang Negele and Stefan Bieringer, currently pending, the entire disclosure of which is incorporated herein by reference.

FIELD OF THE INVENTION

The present invention refers to a packaging machine with a protective device and to a method for operating a packaging machine.

BACKGROUND OF THE INVENTION

Tray sealing machines with protective covers are known from WO 2011/154743, specifically shown in FIGS. 1 and 2, and from EP 1996470 B1, specifically FIG. 1, wherein the protective covers are provided on the machine frame to be upwardly pivotable about a horizontal axis. The area covered can thereby be made accessible from a front and rear operator side for cleaning or maintenance work; this requires respectively pivotable protective covers on the front and rear operator side. An access from above is here not possible.

Thermoforming machines are known from practice and EP 1772384 A1, specifically shown in FIG. 3; these comprise protective covers that are not mechanically connected to the machine frame, but the presence of the protective cover is monitored by the machine control by means of sensors. These protective hoods are removable and are deposited on the floor or otherwise at a remote place to make the covered area accessible on all sides for cleaning or maintenance work. Due to the arbitrary removal of the protective hoods and the haphazard deposition by the operating personnel the protective hoods may get damaged, and an accurate repositioning and the subsequent checking by sensors may be aggravated or even prevented. As a possible consequence, the thermoforming machine can no longer be started. Another problem is the risk of soiling on protective hoods placed e.g. on the floor. For reasons of hygiene this is above all critical or not admissible in the food sector.

SUMMARY OF THE INVENTION

It is the object of the present invention to provide a protective device for a packaging machine, preferably for a tray sealing machine or a thermoforming machine, and a method for operating a packaging machine that permits a configuration of a protective device that is as simple as possible, and also an easy accessibility of the area underneath the protective device.

One embodiment of the packaging machine of the present invention with a protective device which comprises a protective hood and a frame is characterized in that the frame comprises a shaft with two rolls and the protective hood comprises guides, said guides cooperating with the rolls such that the protective hood is liftable, tiltable around the shaft and displaceable (shiftable). This protective device which is of a simple configuration and is thus producible at low costs provides excellent accessibility for the operator both laterally from the operation side of the packaging machine and from above. At the same time the protective hood remains connected to the packaging machine and cannot get damaged.

The shaft may be rotatably mounted on the frame. The two rolls can be synchronized with each other by means of the shaft to support a straight movement of the protective hood.

In an one configuration, the rolls comprise a running surface of such a high friction that a sliding friction along the guides is prevented.

In a further configuration, the rolls have a running surface with damping to enable a damping action with a stop of the protective hood without any further damping elements.

The running surfaces of the rolls can be made from an elastomer so as to exhibit high friction and to achieve a damping action at the same time. The elastomer may, for example, be rubber or silicone.

A device may be provided for monitoring the work position of the protective hood to initiate a production start by way of a machine control only if the protective hood is in its work position.

The protective hood can be removed in a removal position in a keyless manner from the protective device so as to further improve accessibility also from the rear side of the packaging machine for special maintenance purposes.

The method according to one embodiment of the invention for operating a packaging machine with a protective device for moving a protective hood comprises the following steps:

- lifting and tilting the protective hood around a shaft,
- shifting the protective hood along guides in the protective hood that are running on two rolls of the shaft, and
- tilting the protective hood around the shaft into an end position.

The advantage consists in an easy operation of the protective device in that the protective hood can be lifted and shifted rearwards or transversely relative to a production direction so as to make the region located thereunder accessible to the operating personnel for cleaning or maintenance purposes over an area that is as large as possible.

The rolls can act as dampers in the end position after the shifting of the protective hood so as to avoid damage and noise when the end position has been reached.

A straight shifting of the protective hood can be supported by means of the shaft and the two rolls synchronized with each other on the shaft, so that no further guiding devices are needed for such a straight movement.

In one configuration, the position of the protective hood in a work position is checked by means of at least one device for monitoring the work position, wherein the device may be a sensor or a switch, and a machine control will initiate a production start only if the protective hoods are in their work position. The monitoring device can also operate in a contactless manner.

The protective hood can be removed in a removal position in a keyless manner in one embodiment.

DESCRIPTION OF THE SEVERAL VIEWS OF THE DRAWING

An advantageous embodiment of the invention shall now be explained in more detail with reference to a drawing. In detail.

Like components are provided with like reference numerals throughout the figures.

DETAILED DESCRIPTION OF THE INVENTION

Figure 1:
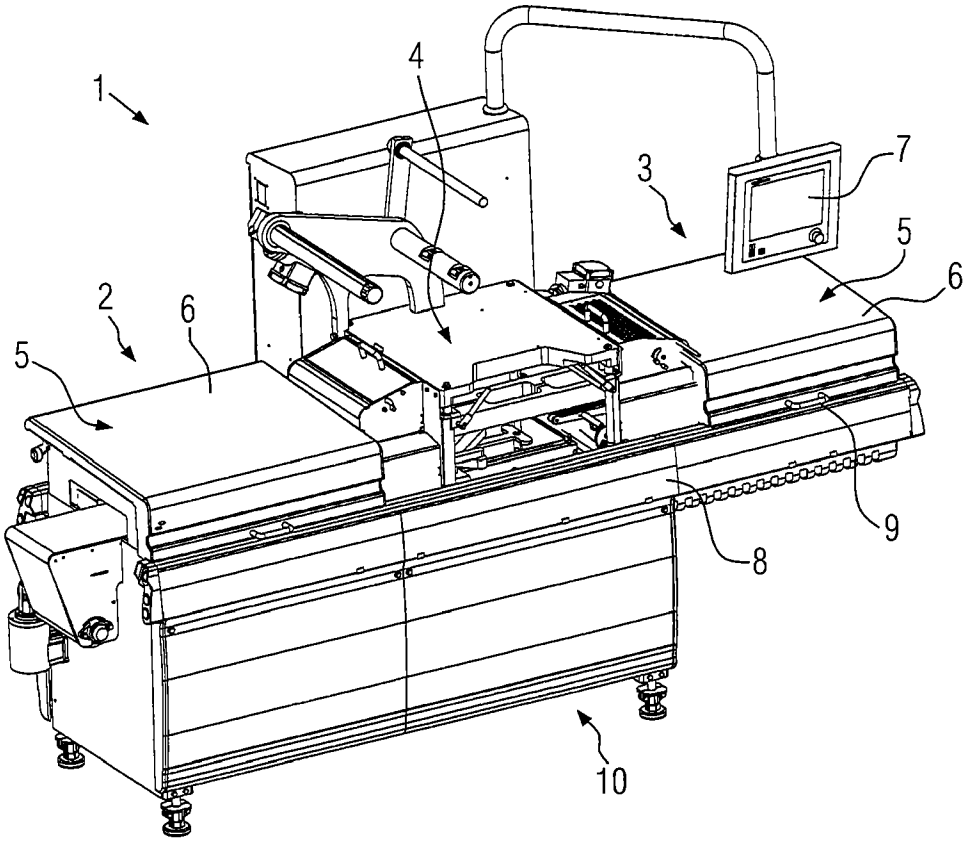
FIG. 1 is a schematic view of a tray sealing machine according to one embodiment of the invention with a protective device in a work position.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a tray sealing machine 1 according to one embodiment of the present invention with a sealing station 4 disposed between a discharge device 2 and a supply device 3. Each of the supply and discharge devices 3, 2 may comprise a protective device 5 with a respective protective cover 6, the positioning of which in a closed or work position can be monitored by means of sensors (not shown in more detail) by a machine control 7, so that the tray sealing machine 1 can only be started by an operator if both protective hoods 6 are in the work position. In the work position the protective hoods 6 are positioned on the machine frame 8, thereby preventing any access into the area covered. The protective hoods 6 may be equipped on the operation side 10 of the tray sealing machine 1 with a grip 9 to permit a manual operation of the protective device 5 and of the protective hood 6 as such.

Figure 2:
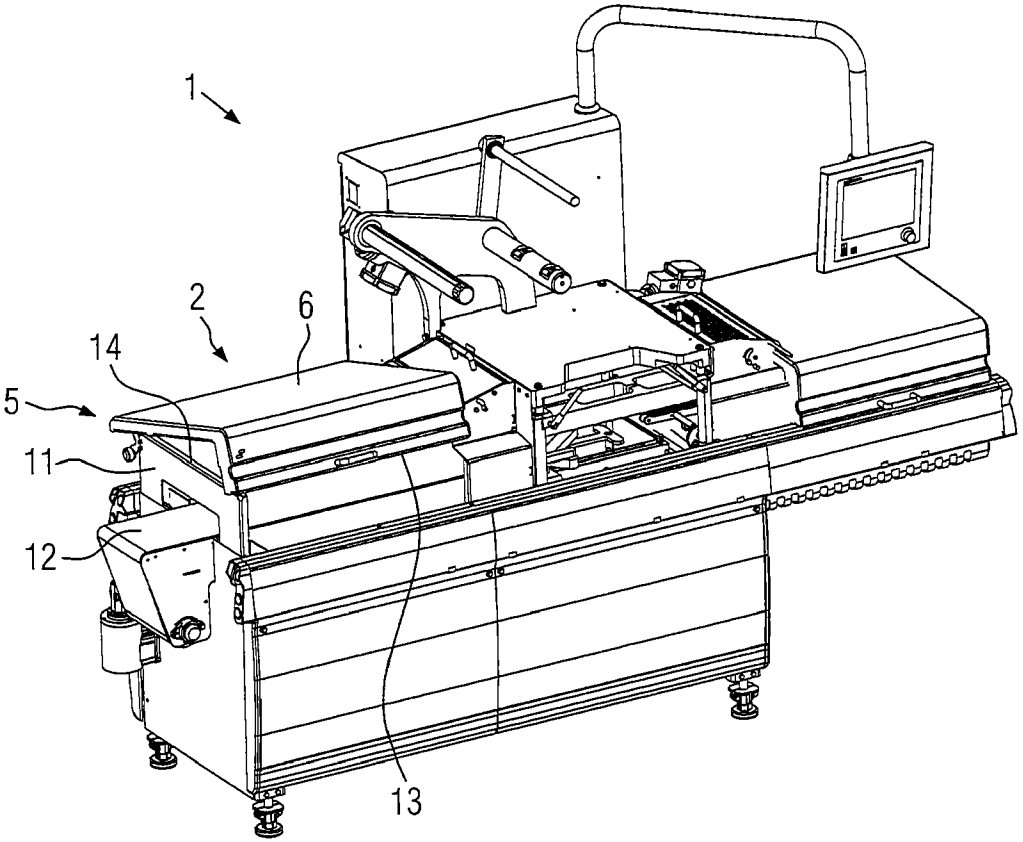
FIG. 2 is a schematic view of the protective device in a lifted position according to one embodiment of the invention.

FIG. 2 shows the tray sealing machine 1 with a lifted protective hood 6 on the discharge device 2. The protective device 5 on the discharge device 2 may further comprise a frame 11 which extends laterally, arranged in the figure at the left side on the discharge device 2, and along the back side of the tray sealing machine 1. The protective device 5 ensures that a section of a servo-driven transport belt 12 which discharges trays out of the sealing station 4 and the tray sealing machine 1 is covered. In the sealing station 3 the trays may be sealed with a lid film. The protective hood 6 may be lifted in the opening process to such an extent that the front lower edge 13 of the protective hood 6 is positioned above the upper edge 14 of the frame 11 to subsequently permit a displacement of the protective hood 6 to the rear. The lifting operation can be carried out around a shaft 15, which is visibly shown in FIGS. 3 and 4.

Figure 3:
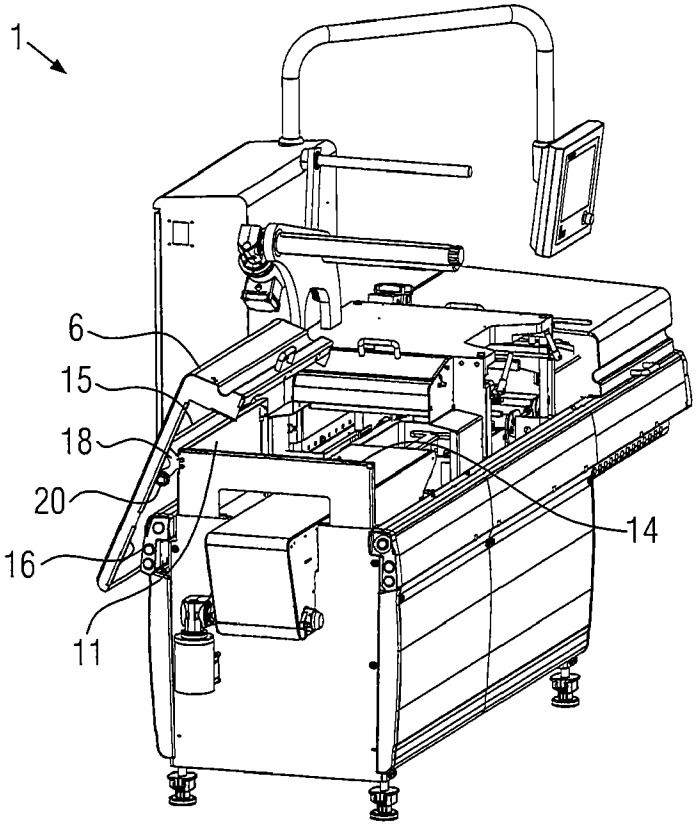
FIG. 3 is a schematic view of the protective device in an opened position according to one embodiment of the invention.

FIG. 3 shows the tray sealing machine 1 with the protective hood 6, which has been shifted rearwards into the opened position. The protective hood 6 may grip around rolls 17, which are shown in more detail in FIG. 4, with guides 16 that are given a laterally oriented L- or U-shape (as shown) by way of sheet metal bends. The rolls 17 as such can be connected to the shaft 15 at the shaft ends thereof and the shaft 15 may be mounted on the frame 11 of the protective device 5 via two holders 18. Since the rolls 17 may have a rubber-lined running surface of high friction, the sliding movement of the protective hood 6 can be synchronized such that the protective hood 6 performs a rearwardly directed straight movement, with the guides 16 running on the rolls 17 in this process. During said movement the protective hood 6 is continuously tilting downwards due to the shaft 15 being arranged at a lower level than the upper edge 14 of the frame, and due to the rolls 17, respectively. In the position shown in FIG. 3, the protective hood 6 is positioned with two stops 19 (shown in FIG. 4), which are provided in the guides 16, on the rolls 17, which due to their rubber-lined running surface may additionally act as dampers. Each of the holders 18 additionally can comprise a further rubber or plastic roll 20, which serves as an abutment for the protective hood 6 in the opened position and thereby limits the inclination of the protective hood 6. The position of the protective hood 6 in the opened position is thereby defined via the rolls 17 and the rolls 20 and is also called end position. The rolls 20 need not be rotatably mounted on the holders 18.

Figure 4:
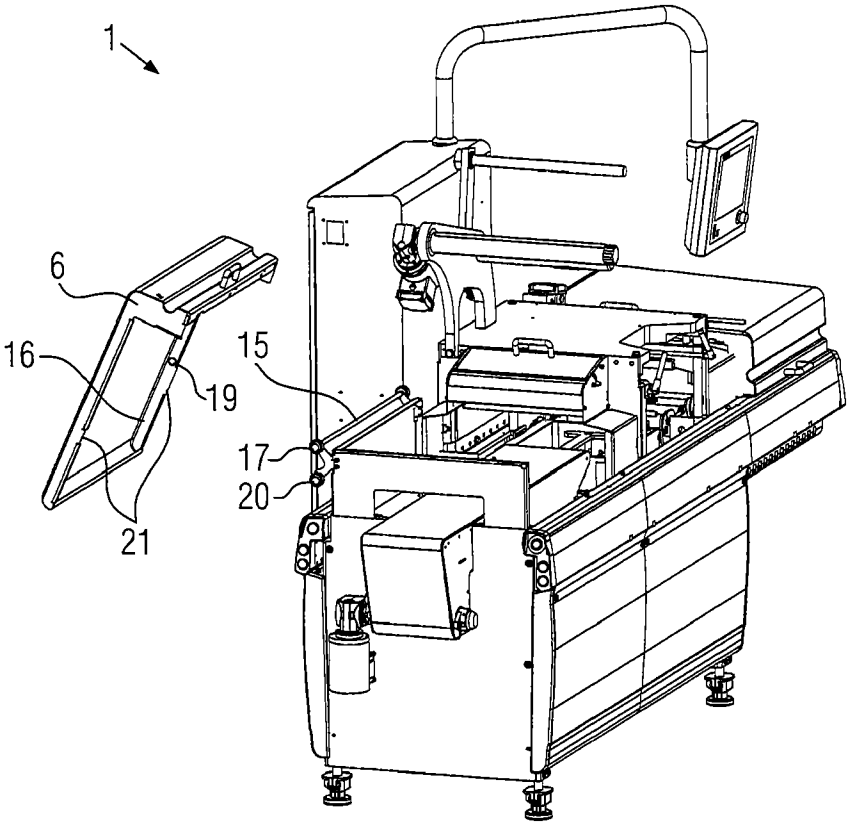
FIG. 4 is a schematic view of the protective device with a removed protective hood according to one embodiment of the invention.

FIG. 4 shows the tray sealing machine 1 with a protective hood 6 removed from the protective device 5. In this view, the two internal guides 16 and a respective recess 21 of the protective hood 6 are shown. To be able to remove the protective hood 6 from the rolls 17, the protective hood 6 may be lifted into a removal position so that the rolls 17 are positioned in the area of the recess 21, and the rolls 17 can pass out of the guides 16. To sum up, it should be noted that the opening movement and also the closing movement of the protective hood 6 may be defined just by the arrangement and cooperation of the shaft 15 together with the two rolls 17 on the frame 11 of the protective device 5 and the guides 18 with the stops 19 of the protective hood 6.

The invention is not limited to a tray sealing machine 1, but alternatively relates to a thermoforming machine and transport devices which supply products and discharge packs and form a packaging system together with the packaging machine. All of these apparatuses may comprise a protective device 5 in one of the variants as described herein.

The scope of the invention also comprises an equivalent configuration where, instead of the shaft 15 with the two rolls 17, sliding elements are provided that are cooperating with the protective hood in the same way.

In the embodiment shown in the figures, the frame 11 in the production direction of the packaging machine 1 is shorter than the protective hood 6. This has the consequence that even in the case of an unintended lowering of the protective hood 6 the front lower edge 13 of the protective hood 6 will rest on the upper edge 14 of the frame 11 (see FIG. 2) as soon as the protective hood 6 is shifted by a short distance to the rear. The operating reliability of the packaging machine 1 is thereby improved since the contact between the edges 13, 14 prevents the edge 13 of the protective hood 6 from getting into contact, for instance, with the transport belt 2 or with trays positioned thereon.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A packaging machine, said packaging machine comprising:

a sealing station;

a frame disposed at one of a supply side or a discharge side of said sealing station, said frame disposed at least partially above one of a first transport belt of a supply device on said supply side, or a second transport belt of a discharge device on said discharge side, said frame having a shaft mounted for rotation thereon and two rolls are disposed on said shaft;

a protective hood operably connected to said frame, said protective hood including one or more guides;

wherein said rolls are positioned on said shaft to engage the one or more guides of said protective hood, and the one or more guides cooperate with the rolls in such a manner that the protective hood is liftable and tiltable around the shaft and a movement of the protective hood between a closed position and an opened position comprises at least a rearwardly directed linear movement; and wherein said protective hood is disposed above one of said first transport belt or said second transport belt when the protective hood is in the closed position.

2. The packaging machine according to claim 1, wherein the two rolls are synchronized with each other by means of the shaft.

3. The packaging machine according to claim 1, wherein the rolls each have a running surface with friction.

4. The packaging machine according to claim 3, wherein the running surfaces of the rolls are made from an elastomer.

5. The packaging machine according to claim 1, wherein the rolls each have a running surface with damping.

6. The packaging machine according to claim 1, wherein a monitoring device is provided for monitoring the closed position of the protective hood.

7. The packaging machine according to claim 1, wherein the protective hood is removable in a removal position in a keyless manner from the protective device.

8. The packaging machine according to claim 1, wherein the transport belt is driven by a servo-drive.

9. The packaging machine according to claim 1, wherein the guides comprise a sheet-metal bend on the protective hood having one of an L-shape or a U-shape bend.

10. The packaging machine according to claim 1, wherein the shaft is disposed at a first vertical position that is lower than a second vertical position of an upper edge of a frame of said packaging machine.

11. The packaging machine according to claim 1, wherein the protective hood includes at least one recess proximate the guides, wherein said protective hood may be disengaged from at least one of said rollers at said at least one recess.

12. The packaging machine according to claim 1, wherein the transport belt has a direction of production and wherein a downstream side of said protective hood is disposed downstream of the downstream end of a frame of said packaging machine.

13. A method for operating a packaging machine with a protective device for moving a protective hood, the method comprising the following steps:

moving the protective hood between a closed position to an open position;

lifting and tilting the protective hood around a shaft, shifting the protective hood such that a movement of the protective hood between a closed position and an opened position comprises at least a rearwardly directed linear movement, the guides running on two rolls of the shaft, and tilting the protective hood around the shaft into an end position; and one of disabling a transport belt of the packaging machine when said protective hood is in the open position, or operating the transport belt of the packaging machine when said protective hood is in the closed position.

14. Method according to claim 13, wherein the rolls act as dampers in the end position after shifting of the protective hood.

15. Method according to claim 13, wherein a straight shifting of the protective hood is supported by means of the shaft and the two rolls synchronized with each other on the shaft.

16. Method according to claim 13, further comprising checking the protective hood is in the closed position using at least one monitoring device for monitoring the work position.

17. Method according to claim 13, wherein the protective hood can be removed in a removal position in a keyless manner.

18. A packaging machine, said packaging machine comprising:

a supply device, said supply device comprising a first transport belt;

a discharge device, said discharge device comprising a second transport belt;

a sealing station disposed between said supply device and said discharge device;

a frame disposed at least partially above one of said supply device or said discharge device, said frame having a shaft mounted for rotation thereon and two rolls are disposed on said shaft;

a protective hood operably connected to said frame, said protective hood including one or more guides;

wherein said rolls are positioned on said shaft to engage the one or more guides of said protective hood, and the one or more guides cooperate with the rolls in such a manner that the protective hood is liftable and tiltable around the shaft and a movement of the protective hood between a closed position and an opened position comprises at least a rearwardly directed linear movement; and wherein said protective hood is disposed above one of said first transport belt or said second transport belt when the protective hood is in the closed position.

* * * * *